US010006232B2

(12) United States Patent
Liang et al.

(10) Patent No.: US 10,006,232 B2
(45) Date of Patent: Jun. 26, 2018

(54) WINDOW VENT STOP WITH FLEXIBLE SIDE ENGAGEMENT PIECES

(71) Applicants: Luke Liang, So. Plainfield, NJ (US); Tong Liang, Guangzhou (CN); David Chen, Guangzhou (CN)

(72) Inventors: Luke Liang, So. Plainfield, NJ (US); Tong Liang, Guangzhou (CN); David Chen, Guangzhou (CN)

(73) Assignee: Vision Industries Group, So. Plainfield, NJ (US)

( * ) Notice: Subject to any disclaimer, the term of this patent is extended or adjusted under 35 U.S.C. 154(b) by 0 days. days.

(21) Appl. No.: 14/198,949

(22) Filed: Mar. 6, 2014

(65) Prior Publication Data

US 2014/0306462 A1 Oct. 16, 2014
US 2016/0369539 A9 Dec. 22, 2016

Related U.S. Application Data

(63) Continuation of application No. 12/658,642, filed on Feb. 9, 2010, now Pat. No. 8,833,809, which is a (Continued)

(51) Int. Cl.
*E05C 3/12* (2006.01)
*E06B 7/02* (2006.01)
(Continued)

(52) U.S. Cl.
CPC ..... *E05C 3/124* (2013.01); *E05C 17/60* (2013.01); *E06B 7/02* (2013.01); *E06B 7/28* (2013.01); *E05B 9/08* (2013.01); *E05B 15/0053* (2013.01); *E05B 65/0829* (2013.01); *E05B 2015/0496* (2013.01); *E05C 2007/007* (2013.01); *Y10S 292/20* (2013.01); *Y10S 292/46* (2013.01);
(Continued)

(58) Field of Classification Search
CPC .... E05C 3/124; E05C 17/60; E05C 2007/007; E06B 7/28; E06B 7/02; E05B 9/08
USPC ..... 292/219, 220, 228, DIG. 47, DIG. 46, 292/DIG. 20, DIG. 33; 49/449
See application file for complete search history.

(56) References Cited

U.S. PATENT DOCUMENTS 36,524 A 9/1862 Minor
51,222 A 11/1865 Ridell
(Continued)

FOREIGN PATENT DOCUMENTS

GB 2 286 627 8/1995
GB 2 461 079 12/2009
(Continued)

*Primary Examiner* — Gregory J Strimbu
(74) *Attorney, Agent, or Firm* — Thomas A. O'Rourke; Bodner & O'Rourke, LLP

(57) ABSTRACT

A window vent stop for use in a sliding sash window assembly or a sliding door assembly. The vent stop has a housing adapted to be disposed in a recess in a non-movable sash member. A tumbler has at least one pivot for pivotally securing the tumbler to the housing for movement between an extended position, to prevent movement of a sliding member and a retracted position to allow movement of the sliding member. Also within the housing is a spring for biasing the tumbler. The housing has one or more flexible members extending from the end walls of the housing that secure the housing to an opening in the non-movable sash member.

5 Claims, 16 Drawing Sheets

Related U.S. Application Data continuation of application No. 11/977,445, filed on Oct. 24, 2007, now Pat. No. 8,235,430, which is a continuation-in-part of application No. 11/390,467, filed on Mar. 28, 2006, now Pat. No. 7,530,611.

(51) Int. Cl.

| | |
|---|---|
| ***E05C 17/60*** | (2006.01) |
| ***E06B 7/28*** | (2006.01) |
| *E05B 65/08* | (2006.01) |
| *E05C 7/00* | (2006.01) |
| *E05B 9/08* | (2006.01) |
| *E05B 15/00* | (2006.01) |
| *E05B 15/04* | (2006.01) |

(52) U.S. Cl.

CPC ..... *Y10S 292/47* (2013.01); *Y10T 292/1051* (2015.04); *Y10T 292/1052* (2015.04); *Y10T 292/1061* (2015.04); *Y10T 292/65* (2015.04)

(56) References Cited

U.S. PATENT DOCUMENTS 108,778 A 11/1870 Gorman
115,781 A 6/1871 Steele
126,872 A 5/1872 Buckman
148,857 A 3/1874 Smith
166,842 A 8/1875 Berryman
178,360 A 6/1876 Cooper
192,614 A 7/1877 Andrews
192,919 A 7/1877 Hoyt
201,146 A 3/1878 Adler
215,125 A 5/1879 Hunter
226,033 A 3/1880 Burns
230,476 A 7/1880 Green
234,387 A 11/1880 Burgess
284,993 A 9/1883 Abele
314,350 A 3/1885 Smith
316,285 A 4/1885 McKeen
331,005 A 11/1885 Sahr
336,302 A 2/1886 Dudgeon
346,788 A 8/1886 Teufel
350,678 A 10/1886 Hussey
353,287 A 11/1886 Chumard
369,885 A 9/1887 Shaw
375,656 A 12/1887 Shaw
376,252 A 1/1888 McIntyre
379,910 A 3/1888 Resantreter
410,728 A 9/1889 Brown
417,868 A 12/1889 Janes
423,761 A 3/1890 Hasenpflug
452,723 A 5/1891 Schmalhausen
480,148 A 8/1892 Theby
493,159 A 3/1893 Gibson
509,941 A 12/1893 Perry
512,593 A 1/1894 Webster
520,754 A 5/1894 Burmeister
526,118 A 9/1894 Sharp
528,656 A 11/1894 Burmeister
530,078 A 12/1894 Ammerman
534,185 A 2/1895 Winchester
537,258 A 4/1895 Wilcox
539,030 A 5/1895 Bitner
551,181 A 12/1895 Dilton
551,242 A 12/1895 Wallace
554,448 A 2/1896 Kail
564,426 A 7/1896 Hubbard
587,424 A 8/1897 Bonine
590,225 A 9/1897 Hill
653,458 A 7/1900 Paquette
683,928 A 10/1901 Geraghty
688,491 A 12/1901 Sigler
695,736 A 3/1902 Kendrick
699,696 A 5/1902 Mellen
708,406 A 9/1902 Robison
714,343 A 11/1902 Wellman
718,007 A 1/1903 Linn
719,981 A 2/1903 Adams
722,162 A 3/1903 St. Louis
724,466 A 4/1903 Hannan
743,716 A 11/1903 Hadka
744,755 A 11/1903 Hasenpflug
745,888 A 12/1903 McElwee
756,453 A 4/1904 Arens
756,559 A 4/1904 Arens
757,249 A 4/1904 Barnard
759,642 A 5/1904 Sparks
764,493 A 7/1904 Noseworthy
769,386 A 9/1904 Johnson
769,767 A 9/1904 Phelps
774,536 A 11/1904 Saunders
775,602 A 11/1904 Hearnshaw
800,043 A 9/1905 Witte
804,994 A 11/1905 Andrews
815,537 A 3/1906 Kissinger
833,900 A 10/1906 Sigler
837,811 A 12/1906 Ebbeson
840,427 A 1/1907 Brister
865,090 A 9/1907 Eddy
866,073 A 9/1907 Saunders
878,206 A 2/1908 Johnson
881,658 A 3/1908 Bowman
886,108 A 4/1908 Allen
887,690 A 5/1908 Pearce
922,894 A 8/1908 Heid
897,719 A 9/1908 Daubaignan
900,079 A 10/1908 Bittorf
910,850 A 1/1909 Petrie
926,899 A 7/1909 Roy
928,408 A 7/1909 Taube
948,628 A 2/1910 Jefferis
959,150 A 5/1910 Morris
966,063 A 8/1910 Toothaker
976,777 A 11/1910 Brown
980,131 A 12/1910 Shean
998,642 A 7/1911 Shean
1,003,386 A 9/1911 Welker
1,006,211 A 10/1911 Hermon
1,020,454 A 3/1912 Seidenbecker
1,041,803 A 10/1912 Kilburn
1,051,918 A 2/1913 Rowley
1,059,999 A 4/1913 James
1,069,079 A 7/1913 Voight
1,077,487 A 11/1913 Miller
1,080,172 A 12/1913 Rusk
1,100,820 A 6/1914 Edwards
1,121,228 A 12/1914 Burkhart
1,122,026 A 12/1914 O'Rourke
1,127,835 A 2/1915 Westlund
1,133,217 A 6/1915 Barton
1,141,437 A 6/1915 Unterlender
1,148,712 A 8/1915 Overland
1,163,086 A 12/1915 Harper
1,173,129 A 2/1916 Taliaferro
1,177,637 A 4/1916 Lane
1,177,838 A 4/1916 Wilkinson
1,207,989 A 12/1916 O'Rourke
1,232,683 A 7/1917 Hollis
1,243,115 A 10/1917 Shur
1,247,182 A 11/1917 Tuekmantel
1,253,810 A 1/1918 Gianninoto
1,261,274 A 4/1918 Newsam
1,269,467 A 6/1918 Winters
1,270,740 A 6/1918 Keyes
1,272,900 A 7/1918 Berman
1,279,353 A 9/1918 Kelley
1,311,052 A 7/1919 Danforth
1,322,677 A 11/1919 Diffefsen
1,338,250 A 4/1920 Parkes
1,338,416 A 4/1920 Bellinger
1,339,362 A 5/1920 L'Heureux
1,341,234 A 5/1920 Horton
1,350,698 A 8/1920 Boedtcher

(56) References Cited

U.S. PATENT DOCUMENTS 1,387,302 A 8/1921 Page
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,464,467 A 7/1923 Stuart
1,463,866 A 8/1923 Bourbeau
1,470,858 A 10/1923 Maxwell
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,587,037 A 6/1926 Rudolph
1,601,051 A 9/1926 Wilbert
1,605,717 A 11/1926 Gregg
1,619,031 A 3/1927 Ostfosky
1,622,742 A 3/1927 Shipman
1,658,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,891,940 A 12/1932 McAllister
1,800,936 A 3/1933 Hutfger
1,901,974 A 3/1933 Macy
1,922,062 A 8/1933 Sullivan
1,960,034 A 5/1934 Stewart
1,964,114 A 6/1934 Gerlach
2,095,057 A 10/1937 Corrado
2,122,661 A 7/1938 Rightmyer
2,126,995 A 8/1938 Kingdon
2,136,408 A 11/1938 Bedell
2,158,260 A 5/1939 Stillman
2,202,561 A 5/1940 Lahiere
2,272,145 A 2/1942 Anderson
2,294,683 A 9/1942 Murphy
2,326,084 A 8/1943 Westrope
2,369,584 A 2/1945 Lundholm
2,452,521 A 10/1948 Johnson
2,480,016 A 8/1949 Granberg
2,480,988 A 9/1949 Walton
2,500,349 A 3/1950 DeGroote et al.
2,503,370 A 4/1950 Zanona
2,523,559 A 9/1950 Couture
2,527,278 A 10/1950 Schemansky
2,537,736 A 1/1951 Carlson
2,560,274 A 7/1951 Cantelo
2,590,624 A 3/1952 James
2,599,196 A 6/1952 Pererni
2,605,125 A 7/1952 Emerson
2,612,398 A 9/1952 Miller
2,613,526 A 10/1952 Holmsten
2,621,951 A 12/1952 Ostadal
2,637,576 A 5/1953 Nottingham
2,645,515 A 7/1953 Thomas
2,648,967 A 8/1953 Holmsten
2,670,982 A 3/1954 Banham
2,692,789 A 10/1954 Rivard
2,758,862 A 8/1956 Endter
2,766,492 A 10/1956 Day
2,789,851 A 4/1957 Lickteig
2,789,852 A 4/1957 Eads
2,818,919 A 8/1958 Sylvan
2,846,258 A 8/1958 Granberg
2,855,772 A 10/1958 Hillgren
2,884,276 A 4/1959 Baptist
2,941,832 A 6/1960 Grossman
3,027,188 A 3/1962 Eichstadt
3,135,542 A 6/1964 Wilkenson
3,187,526 A 6/1965 Moler
3,267,613 A 8/1966 McQuiston
3,288,510 A 11/1966 Gough
3,352,586 A 11/1967 Hakanson
3,362,740 A 1/1968 Burns
3,422,575 A 1/1969 Armstrong
3,425,729 A 2/1969 Bisbing
3,438,153 A 4/1969 Lemme
3,599,452 A 8/1971 Maruyama
3,600,019 A 8/1971 Toyota
3,642,315 A 2/1972 Alpern
3,645,573 A 2/1972 Strang
3,683,652 A 8/1972 Halopoff
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
4,054,308 A 10/1977 Prohaska
4,059,298 A 11/1977 van Klompenburg
4,063,766 A 12/1977 Granberg
4,068,871 A 1/1978 Mercer
4,095,827 A 6/1978 Stavenau
4,095,829 A 6/1978 Van Klompenburg
4,102,546 A 7/1978 Costello
4,151,682 A 5/1979 Schmidt
4,165,894 A 8/1979 Wojciechowski
4,223,930 A 9/1980 Costello
4,227,345 A 10/1980 Durham
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham
4,580,366 A 4/1986 Hardy
4,587,759 A 5/1986 Gray
4,621,847 A 11/1986 Paulson
4,624,073 A 11/1986 Randall
4,639,021 A 1/1987 Hope
4,643,005 A 2/1987 Logas
4,655,489 A 4/1987 Bisbing
4,736,972 A 4/1988 Mosch
4,801,164 A 1/1989 Mosch
4,813,725 A 3/1989 Mosch
4,824,154 A * 4/1989 Simpson ..... 292/338
4,827,685 A 5/1989 Schmidt
4,893,849 A 1/1990 Schlack
4,922,658 A 5/1990 Coddens
4,923,230 A * 5/1990 Simpson ..... 292/67
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim
5,076,015 A 12/1991 Manzalini
5,087,087 A 2/1992 Vetter
5,087,088 A 2/1992 Milam
5,090,750 A 2/1992 Lindqvist
5,090,754 A 2/1992 Thompson
5,110,165 A 5/1992 Piltingsrud
5,127,685 A 7/1992 Dallaire
5,139,291 A 8/1992 Schultz
5,143,412 A 9/1992 Lindqvist
5,161,839 A 11/1992 Piltingsrud
5,165,737 A 11/1992 Riegelman
5,183,310 A 2/1993 Shaughnessy
5,219,193 A 6/1993 Piltingsrud

(56) References Cited

U.S. PATENT DOCUMENTS

| | | | | |
|---|---|---|---|---|
| 5,244,238 | A | 9/1993 | Lindqvist | |
| 5,248,174 | A * | 9/1993 | Matz et al. | 292/338 |
| 5,274,955 | A | 1/1994 | Dallaire | |
| 5,341,752 | A | 8/1994 | Hambleton | |
| 5,398,447 | A | 3/1995 | Morse | |
| 5,437,484 | A | 8/1995 | Yamada | |
| 5,448,857 | A | 9/1995 | Stormo | |
| 5,452,925 | A | 9/1995 | Huang | |
| 5,454,609 | A | 10/1995 | Slocomb | |
| 5,536,052 | A * | 7/1996 | Maier | 292/63 |
| 5,560,149 | A | 10/1996 | Lafevre | |
| 5,582,445 | A | 12/1996 | Olsen | |
| RE35,463 | E | 2/1997 | Vetter | |
| 5,636,475 | A | 6/1997 | Nidelkoff | |
| 5,688,000 | A | 11/1997 | Dolman | |
| 5,715,631 | A | 2/1998 | Kailian et al. | |
| 5,741,032 | A | 4/1998 | Chaput | |
| 5,778,602 | A | 7/1998 | Johnson | |
| 5,791,700 | A | 8/1998 | Biro | |
| 5,806,900 | A * | 9/1998 | Bratcher et al. | 292/137 |
| 5,839,767 | A | 11/1998 | Piltingsrud | |
| 5,901,499 | A | 5/1999 | Delaske | |
| 5,901,501 | A | 5/1999 | Fountaine | |
| 5,911,763 | A | 6/1999 | Quesada | |
| 5,927,768 | A | 7/1999 | Dallmann | |
| 5,970,656 | A | 10/1999 | Maier | |
| 5,992,907 | A | 11/1999 | Sheldon | |
| 6,000,735 | A | 12/1999 | Jourdenais | |
| 6,086,121 | A | 7/2000 | Buckland | |
| 6,116,665 | A | 9/2000 | Subliskey | |
| 6,135,510 | A | 10/2000 | Diginosa | |
| 6,139,071 | A | 10/2000 | Hopper | |
| 6,142,541 | A | 11/2000 | Rotondi | |
| 6,155,615 | A | 12/2000 | Schultz | |
| 6,176,041 | B1 | 1/2001 | Roberts | |
| 6,178,696 | B1 | 1/2001 | Liang | |
| 6,183,024 | B1 | 2/2001 | Schultz | |
| 6,209,931 | B1 | 4/2001 | Von Stoutenborough | |
| 6,217,087 | B1 | 4/2001 | Fuller | |
| 6,230,443 | B1 | 5/2001 | Schultz | |
| 6,250,694 | B1 | 6/2001 | Weiland | |
| 6,279,266 | B1 | 8/2001 | Searcy | |
| 6,349,576 | B2 | 2/2002 | Subliskey | |
| 6,364,375 | B1 | 4/2002 | Szapucki | |
| 6,546,671 | B2 | 4/2003 | Mitchell | |
| 6,565,133 | B1 | 5/2003 | Timothy | |
| 6,572,158 | B2 * | 6/2003 | Szapucki et al. | 292/221 |
| 6,588,150 | B1 | 7/2003 | Wong | |
| 6,592,155 | B1 | 7/2003 | Lemley et al. | |
| 6,607,221 | B1 | 8/2003 | Elliott | |
| 6,631,931 | B2 | 10/2003 | Magnusson | |
| 6,634,683 | B1 | 10/2003 | Brannan | |
| 6,817,142 | B2 | 11/2004 | Marshik | |
| 6,848,728 | B2 | 2/2005 | Rotondi | |
| 6,854,214 | B2 * | 2/2005 | Polowinczak | 49/449 |
| 6,871,885 | B2 | 3/2005 | Goldenberg | |
| 6,871,886 | B2 | 3/2005 | Coleman | |
| 6,877,784 | B2 | 4/2005 | Kelley | |
| 6,925,758 | B2 | 8/2005 | Petit | |
| 6,957,513 | B2 | 10/2005 | Pettit | |
| 6,983,963 | B2 | 1/2006 | Eslick | |
| 7,000,957 | B2 | 2/2006 | Lawrence | |
| 7,013,603 | B2 | 3/2006 | Eenigenburg | |
| 7,063,361 | B1 | 6/2006 | Lawrence | |
| 7,070,211 | B2 | 7/2006 | Polowinczak | |
| 7,070,215 | B2 | 7/2006 | Kelley | |
| 7,100,951 | B2 | 9/2006 | Jien | |
| 7,147,255 | B2 | 12/2006 | Goldenberg | |
| 7,159,908 | B2 | 1/2007 | Liang | |
| 7,296,831 | B2 | 11/2007 | Generowicz | |
| 7,322,620 | B1 | 1/2008 | Lawrence | |
| 7,407,199 | B2 | 8/2008 | Richardson | |
| 7,481,470 | B2 | 1/2009 | Eenigenburg | |
| 7,510,221 | B2 | 3/2009 | Eenigenburg | |
| 7,530,611 | B2 * | 5/2009 | Liang et al. | 292/338 |
| 7,600,796 | B2 * | 10/2009 | Liang et al. | 292/338 |
| 7,607,262 | B2 | 10/2009 | Pettit | |
| 7,665,775 | B1 | 2/2010 | Miller | |
| 7,922,223 | B2 | 4/2011 | Lawrence | |
| 7,976,077 | B2 | 7/2011 | Flory | |
| 8,205,919 | B2 | 6/2012 | Flory | |
| 8,205,920 | B2 | 6/2012 | Flory | |
| 8,235,430 | B2 * | 8/2012 | Liang et al. | 292/338 |
| 8,272,164 | B2 | 9/2012 | Albrecht | |
| 8,550,507 | B2 | 10/2013 | Barton | |
| 8,726,572 | B2 | 5/2014 | Derham | |
| 8,789,862 | B2 | 7/2014 | Liang | |
| 8,833,809 | B2 * | 9/2014 | Liang et al. | 292/219 |
| 8,844,985 | B2 | 9/2014 | Liang | |
| 9,140,033 | B2 | 9/2015 | Wolf | |
| 2005/0011131 | A1 * | 1/2005 | Liang | E05B 65/0852 49/449 |
| 2006/0192391 | A1 | 8/2006 | Pettit | |
| 2006/0244270 | A1 | 11/2006 | Rotondi | |
| 2007/0205615 | A1 | 9/2007 | Eenigenburg | |
| 2008/0169658 | A1 | 7/2008 | Wolf | |
| 2010/0199726 | A1 | 8/2010 | Varney | |
| 2010/0218425 | A1 | 9/2010 | Nolte | |
| 2010/0263415 | A1 | 10/2010 | Ruspil | |
| 2013/0214545 | A1 | 8/2013 | Wolf | |
| 2013/0283695 | A1 | 10/2013 | Hollermann | |
| 2016/0076282 | A1 | 3/2016 | Wolf | |

FOREIGN PATENT DOCUMENTS

| | | |
|---|---|---|
| GB | 2 461 107 | 12/2009 |
| GB | 2 461 108 | 12/2009 |

* cited by examiner

WINDOW VENT STOP WITH FLEXIBLE SIDE ENGAGEMENT PIECES

CROSS REFERENCES TO RELATED APPLICATIONS

This application is a continuation of U.S. application Ser. No. 12/658,642, filed Feb. 9, 2010, now issued as U.S. Pat. No. 8,833,809, which is a divisional of U.S. application Ser. No. 11/977,445, filed Oct. 24, 2007, now issued as U.S. Pat. No. 8,235,430, which is a continuation-in-part of U.S. application Ser. No. 11/390,467, filed Mar. 28, 2006, now issued as U.S. Pat. No. 7,530,611, the disclosures of which are incorporated herein by reference.

FIELD OF THE INVENTION

The present invention relates to improved window vent stops particularly for double hung windows and the like and to improvements in their operation. These window vent stops are used to prevent a window or door from opening more than a desired amount.

BACKGROUND OF THE INVENTION

There are a number of different types of window vent stops available on the market. An example of a window vent stop mechanism is shown in U.S. application Ser. No. 11/390,467, filed Mar. 28, 2007, the disclosures of which are herein incorporated herein by reference. These window vent stops are used to restrict the opening of windows and doors. For example, a window may be opened only a portion due to security concerns or to increase comfort in the room. Window vent stops are primarily used on double hung windows and sliding doors where a sash or a door member slides from a first position to a second position. The window sash lock prevents the sash or the sliding door from moving past a selected point. These sash locks can permit the window to be opened a desired amount for ventilation or other purposes.

There are many different types of windows currently available. These windows include casement windows, transom windows, single hung windows, double hung windows, sliding windows, etc. Double hung windows are windows that have a pair of window sashes that may be raised and lowered. Each sash resides in a pair of tracks or recesses that are typically at each side edge of the window. This permits the lower sash to be raised and the upper sash to be lowered. Traditionally, most windows were made of wood. More recently, the windows including the window sashes have been made of extruded metal or plastic.

Single hung windows are similar in design to double hung windows except that there is only one sash that may be raised or lowered. Sliding windows are also not unlike double hung windows in design. While a double hung window has sashes that are raised and lowered, a sliding window has sashes that are movable along a track to the right or left. Similarly, sliding doors operate the same way as sliding windows.

Double hung windows, single hung windows, sliding windows and sliding doors have a variety of open positions in which they may be placed. While a fully opened position can be desirable for ventilation purposes there can be a downside to the fully opened position. One downside is security. A fully open window or door, however, can be a location for unauthorized ingress and egress from the premises. For example, a double hung window that is opened wide can be a source of danger to small children who may climb up to the window. As a result, many municipalities have enacted laws requiring window guards. Additionally, an opened window or door can provide an invitation to third parties to gain access to the building. As a result, there are a number of vent stops that are available to secure a window or door having sliding members in a partially opened position. One such stop is shown in U.S. Pat. No. 5,248,174 owned by Ashland Products. Another sash stop is shown in U.S. Pat. No. 4,923,230 owned by Ro Mai. In each of these sash stops there is a spring biased tumbler or dog that pivots from an unlocked position to a locked position as desired. These sash locks are positioned in the frame of the upper sash and when the tumbler is pivoted outwardly the position of the tumbler prevents the lower sash from being raised above a preselected position. Other prior art patents for similar products are U.S. Pat. Nos. 5,553,903 and 5,806,900 both of which are owned by Ashland.

One particular problem encountered, however, by users of window vent stops is that the installation becomes a difficult process. In order to install the window vent stop properly, a recess must be cut into the sash stile of the window. This recess must be wide enough to allow the vent stop's initial insertion into the recess, but it must also be snug enough that the vent stop will remain securely installed and able to serve its purpose of preventing the window from being opened wider than a specified distance. Problems occur when a mold of the window vent stop to be installed is used to carve the recess. At times due to mistakes by the person installing or the inaccuracies of the mold used to carve the recess, the recess cut into the sash stile is often not exactly a perfect fit for the vent stop, whether it be too large or too small. Therefore, a new vent stop must be purchased in these situations.

Another problem with the prior art vent stops, is that if a user wants a particular vent stop, that user must purchase a vent stop that is specifically fit for the sash stile thickness of that user's windows. If a user purchases and attempts to install a window vent stop that is either too big or too small for the sash stile in the window, that user must purchase a new window vent stop.

Thus, there is a need in the art for window vent stops with the ability to be used with sash stiles of various thicknesses and with recesses of variable sizes. This would save a user time and money in the installation of the window vent stop. The present invention fulfills this need by using flexible side engagement pieces which allow a particular vent stop to be installed in virtually any sash stile.

OBJECTS OF THE INVENTION

It is an object of the present invention to provide a vent stop that can be installed more easily than the prior art vent stops.

It is another object of the present invention to provide an improved vent stop that is more dependable in its operation than the prior art vent stops.

It is a further object of the present invention to provide a vent stop that provides a mechanism that permits the vent stop to be installed in a variety of different window types and sizes.

It is still another object of the present invention to provide a vent stop that is more flexible in its ability to fit into a variety of recesses carved into a sash stile.

It is still another object of the present invention to provide a vent stop that is more flexible in its ability to fit into a variety of recesses routed into a sash stile.

It is a still further object of the present invention to provide a vent stop that has flexible side engagement pieces which permit the vent stop to be installed in a variety of window types.

SUMMARY OF THE INVENTION

The present invention is directed to an improved vent stop or sash lock for use in a sliding sash window assembly or a sliding door assembly. The window may have one or more sashes usually upper and lower sash window frames installed for vertical sliding movement. Alternatively, the window may have left and right horizontal sliding sashes. The door may also have one or more sliding doors. One sash frame or sliding door frame has a recess into the interior thereof. The vent stop has a housing adapted to be disposed in the recess.

This housing includes a cavity, usually with a bottom plate therein. Inside the cavity is a tumbler that may be in a retracted position and an extended position. When the tumbler is in an extended position the tumbler has a protruding apex at the top. The apex prevents a sash or door from moving when the apex contacts the sash or the door. The tumbler has at least one pivot means for pivotally securing said tumbler to said housing for movement between the extended position and the retracted position. In the extended position the bottom of the tumbler overlies a portion of the second sash to prevent movement of the lower sash past the tumbler. When in a retracted position within said cavity the sash or door can be raised and/or moved past the tumbler without interference. Also within the housing is a spring means for biasing said tumbler into the extended position. The tumbler has at least one means for retaining the tumbler within the housing. The retaining means may be one or more pins that extend laterally from the side of the tumbler and ride within an opening in the sidewall of the housing. Alternatively, the interior wall of the housing may have one or more pins extending toward the tumbler and riding within an opening in the tumbler's side wall.

The housing also has at least one side engagement piece, preferably two, which is preferably made from the same type of material as the housing and is flexible and bendable with the shape of the recess cut into the sash stile into which the window vent stop is placed. These side engagement pieces are intended to aid in the installation of the window vent stop into the sash stile and are flexible so as to enable the installation of the window vent stop in a wide variety of sash stiles of different sizes.

DETAILED DESCRIPTION OF THE PRESENT INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
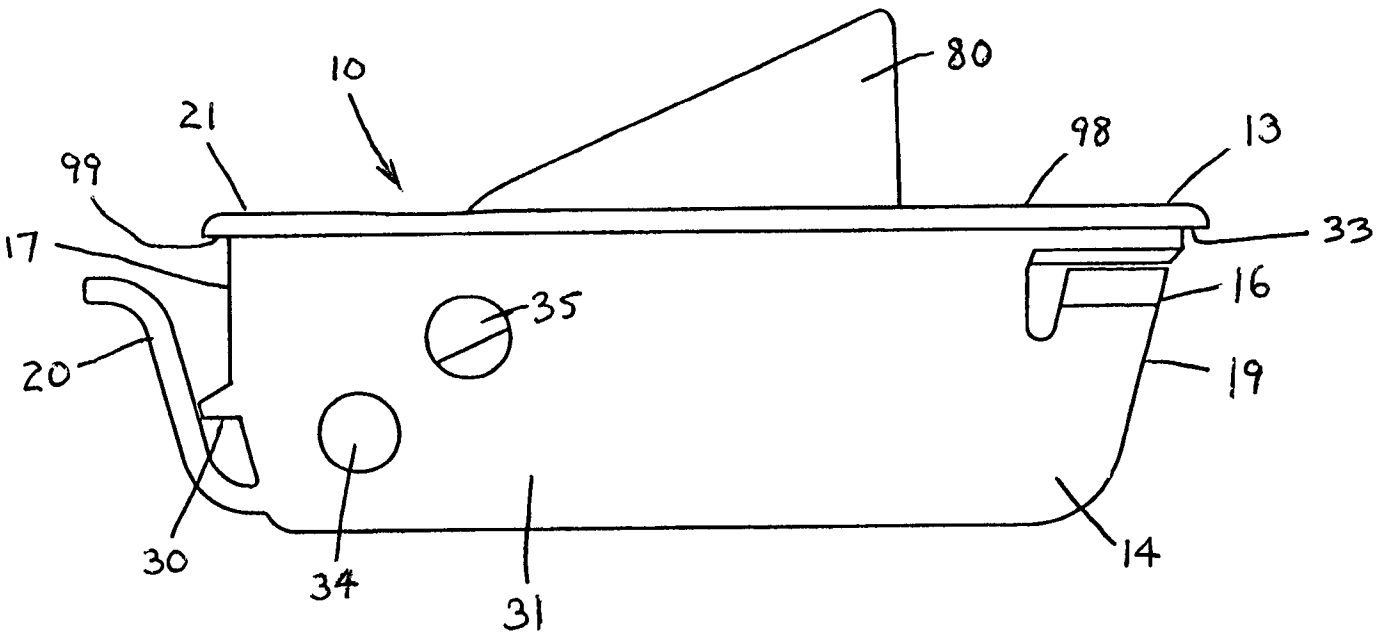
FIG. 1 is a side view of a preferred embodiment of the vent stop of the present invention with the tumbler in the extended position.
Figure 5:
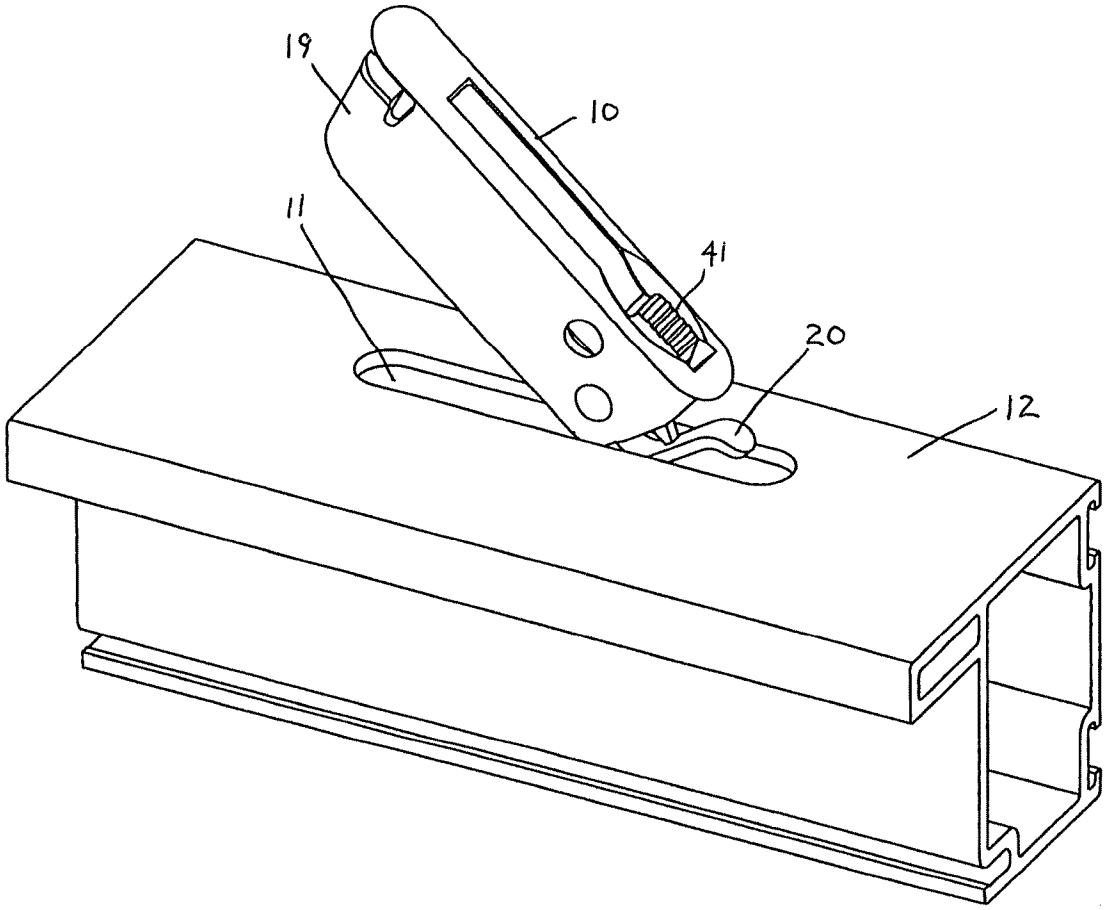
FIG. 5 is a top perspective view of the vent stop of FIG. 1 positioned over a slot in a window or door sash.
Figure 8:
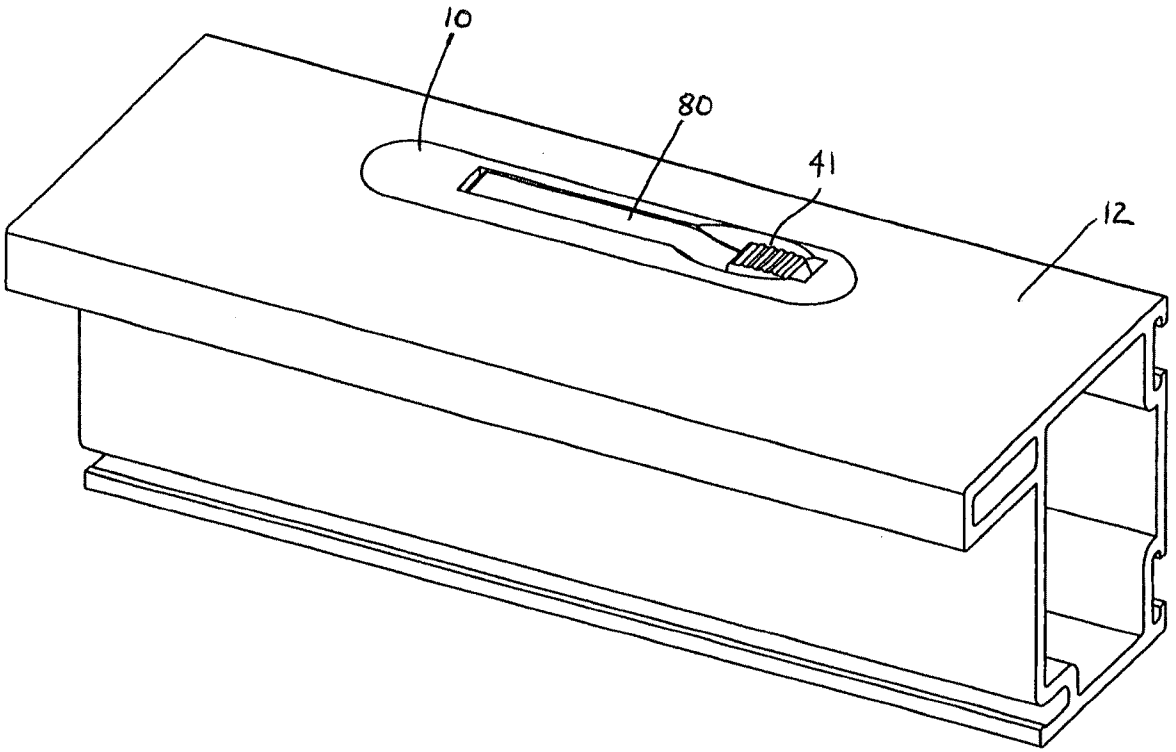
FIG. 8 is a top perspective view of the vent stop of FIG. 1 fully installed in a window or door sash.
Figure 9:
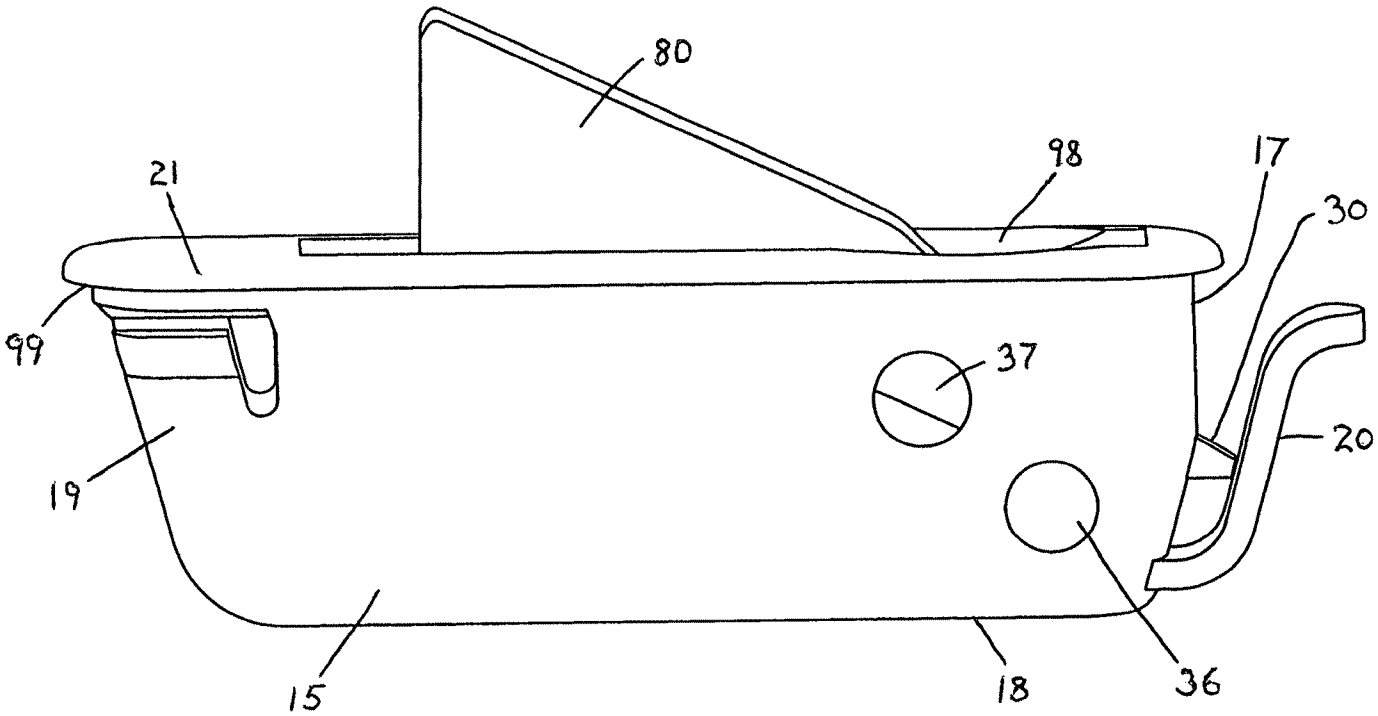
FIG. 9 is a top side perspective view of the vent stop of FIG. 1.
Figure 10:
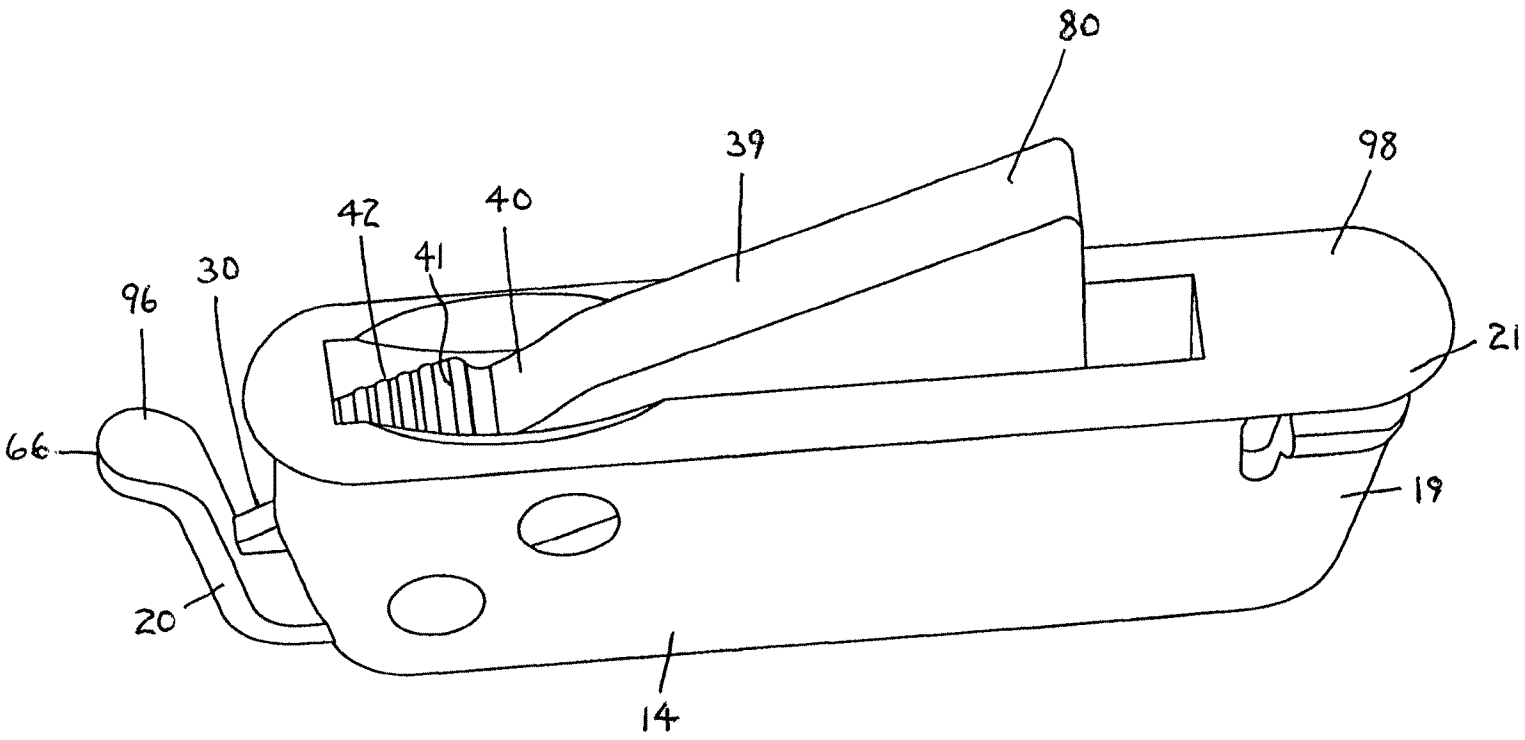
FIG. 10 is a top perspective view of the vent stop of FIG. 1 with the tumbler in the extended position.

In FIG. 1 the window vent stop of the present invention is shown generally at 10. The vent stop 10 is shown positioned over slot 11 in sliding member, such as a window or door sash 12 as seen in FIG. 5. The slot 11 is shown as having an oval shape, but any other suitable shape and size slots including but not limited to a square, rectangle, oval, etc. can be used depending on the shape of the latch. Preferably, however, the vent stop 10 of the present invention will have a portion similarly shaped to the slot 11 as to present a clean appearance when placed in the window sash 12, as seen in FIG. 8. In the present embodiment an oval shape for illustration purposes was used. The window sash can be a sash, doorframe, or any other member that has another piece sliding over it, where restriction of the window sash is desired. The tumbler 80 can be either in a raised or lowered position. When raised it prevents movement of the door or sash, as seen in FIG. 1.

Figure 4:
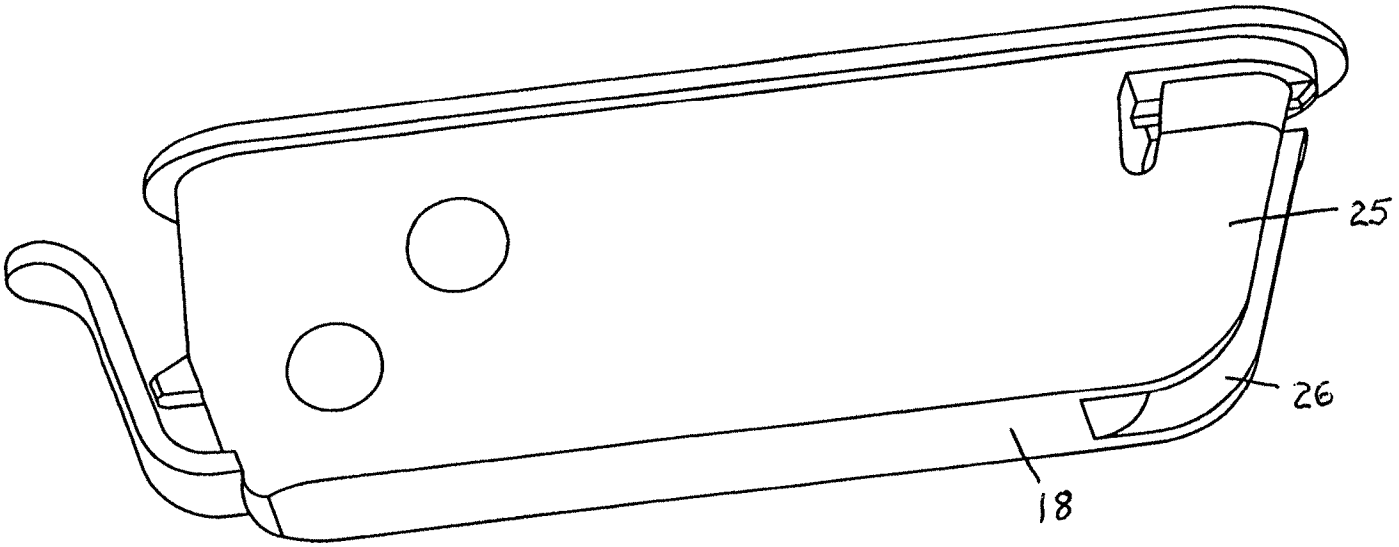
FIG. 4 is a side bottom perspective view of the vent stop of FIG. 1 with the tumbler in the retracted position.
Figure 15:
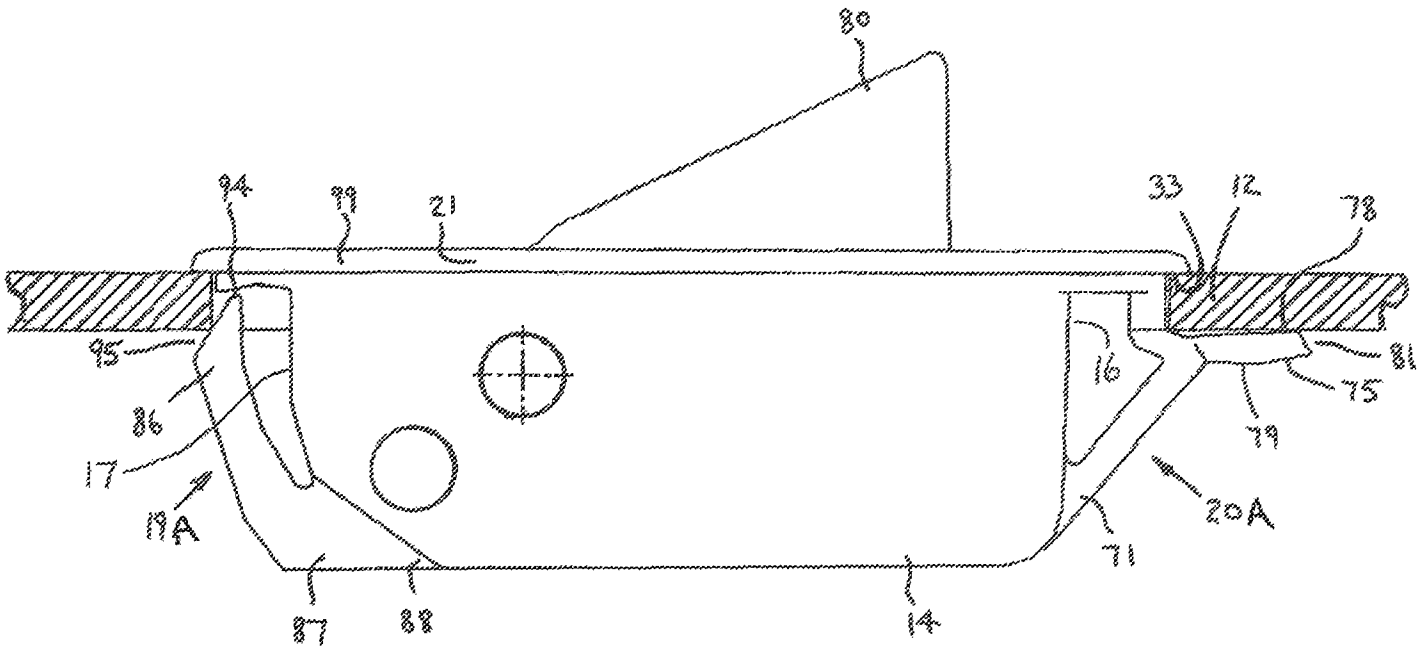
FIG. 15 is a side cross-sectional view of the vent stop of FIG. 14 installed in a sash stile of a greater thickness.

A housing 13 is generally defined by a first sidewall 14, a second sidewall 15, a front wall 16, a rear wall 17, and a bottom wall 18, as shown in FIG. 4. Bottom wall 18 can also serve as a cover. In the present embodiment however bottom wall 18 is sealed, and no cover is present. It is noted that the terms "front" and "rear" are used only for descriptive purposes and do not read on orientation of the device. Sidewalls 14, as seen in FIGS. 1 and 15, are preferably the same length, as are front and rear walls 16 and 17, respectively, providing for a generally rectangular shape to housing 13. Preferably, when in place within slot 11, sidewalls 14 and 15 contact the edges of slot 11 to provide for a tight fit, and prevent a lateral movement of the vent stop 10 within slot 11. There is also a top plate 21 has a top surface 98 and an underside 99, and extends outwardly past the edge of the front and rear walls 16 and 17, creating a lip 33, as seen in FIG. 1. Front wall 16 and rear wall 17 can each have a flexible clip 19 and 20. In one embodiment of the present invention, there is only one flexible clip, first flexible clip 19. However, in the preferred embodiments, there are two clips, first flexible clip 19 and second flexible clip 20. The flexible clips 19 and 20 are preferably not identical, although, in alternate embodiments, they can be identical.

Figure 2:
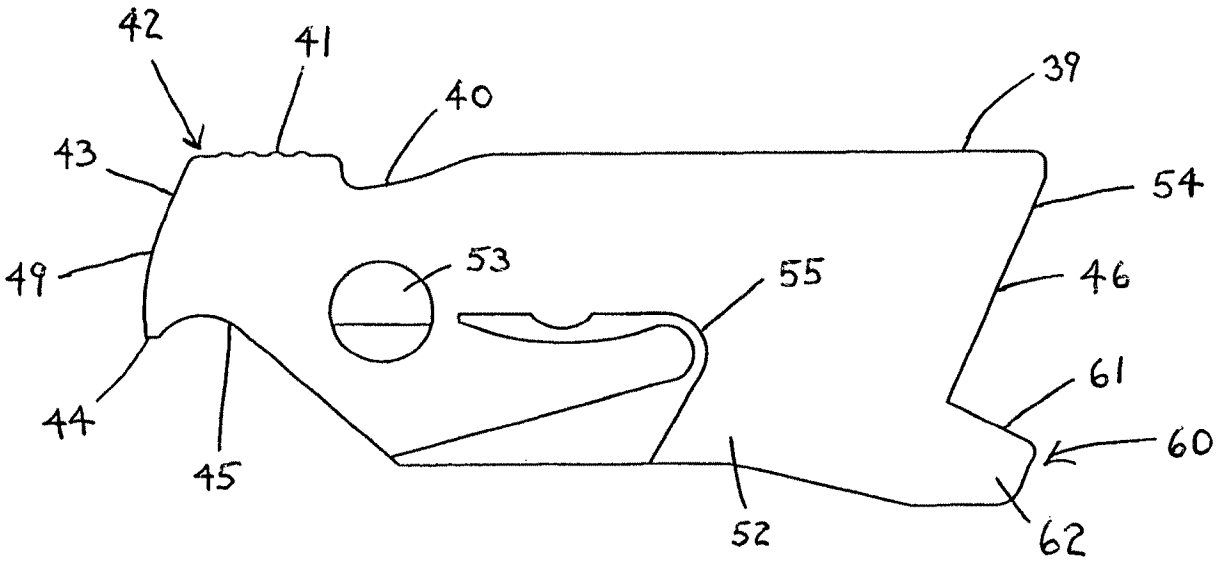
FIG. 2 is a side view of the tumbler of the vent stop of the present invention.
Figure 3:
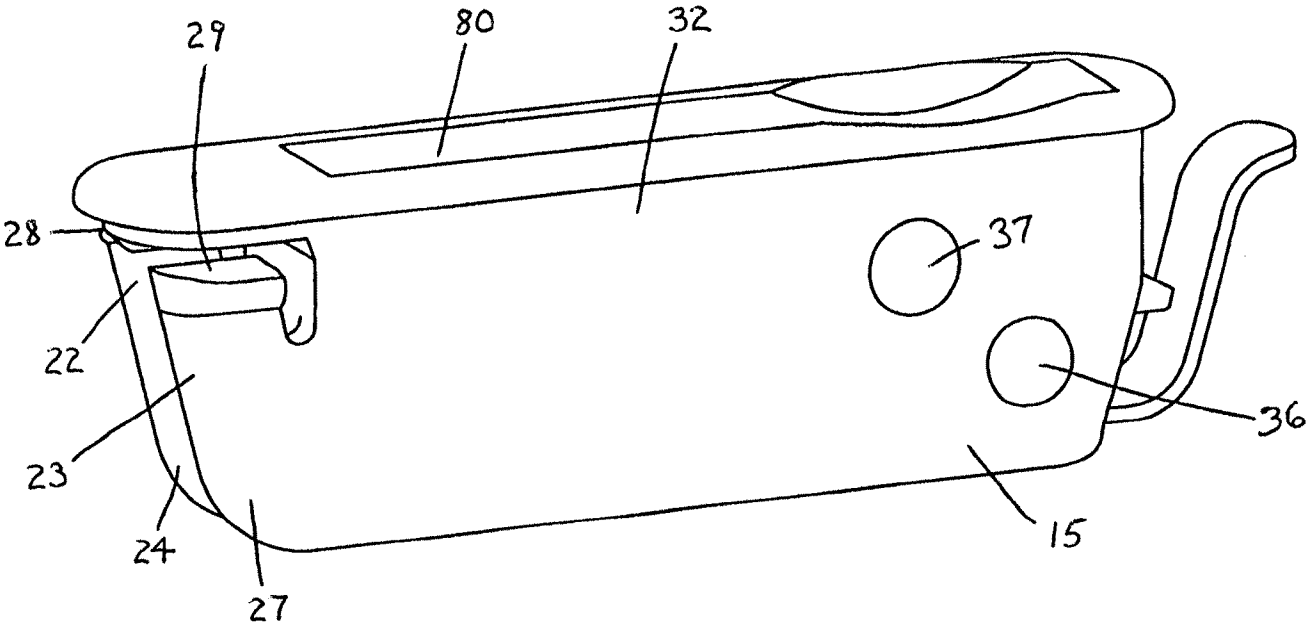
FIG. 3 is a side top perspective view of the vent stop of FIG. 1 with the tumbler in the retracted position.

Either flexible clip 19 or 20 can be attached either front wall 16 or rear wall 17 depending upon a user's preference. As such it should be appreciated, that the embodiments illustrated in FIGS. 1-16 could easily be reversed and the first and second flexible clips 19 and 20 could be on the opposite wall 16 or 17. In one embodiment, illustrated in FIGS. 1-10, first flexible clip 19 can extend generally in an upward fashion, originating at or near the bottom surface 18 of housing 13 and ending typically just below top plate 21, as seen in FIG. 1. In addition, flexible clip 19 may be solid or hollow. In one preferred embodiment, flexible clip 19 may split and be comprised of two generally rectangular protrusions, so as to resemble two teeth, a first "tooth" 22 and a second "tooth" 23, as seen in FIG. 3, located on sidewalls 14 and 15. The first tooth 22 may have inner and outer surfaces, including inner surface 24, as seen in FIG. 3, and outer surface 25, as seen in FIG. 4, located adjacent to sidewall 14. The second tooth 23 may also have inner and outer surfaces, including inner surface 26, as seen in FIG. 4, and outer surface 27, as seen in FIG. 3, located adjacent to sidewall 15. Flexible clip 19 may be affixed to front wall 16 or flexible clip 19 may be an integral part of housing 13, in the present embodiment flexible clip 19 is an integral part of housing 13. In addition, flexible clip 19 has top surfaces 28 and 29, located on teeth 22 and 23 respectively.

Figure 6:
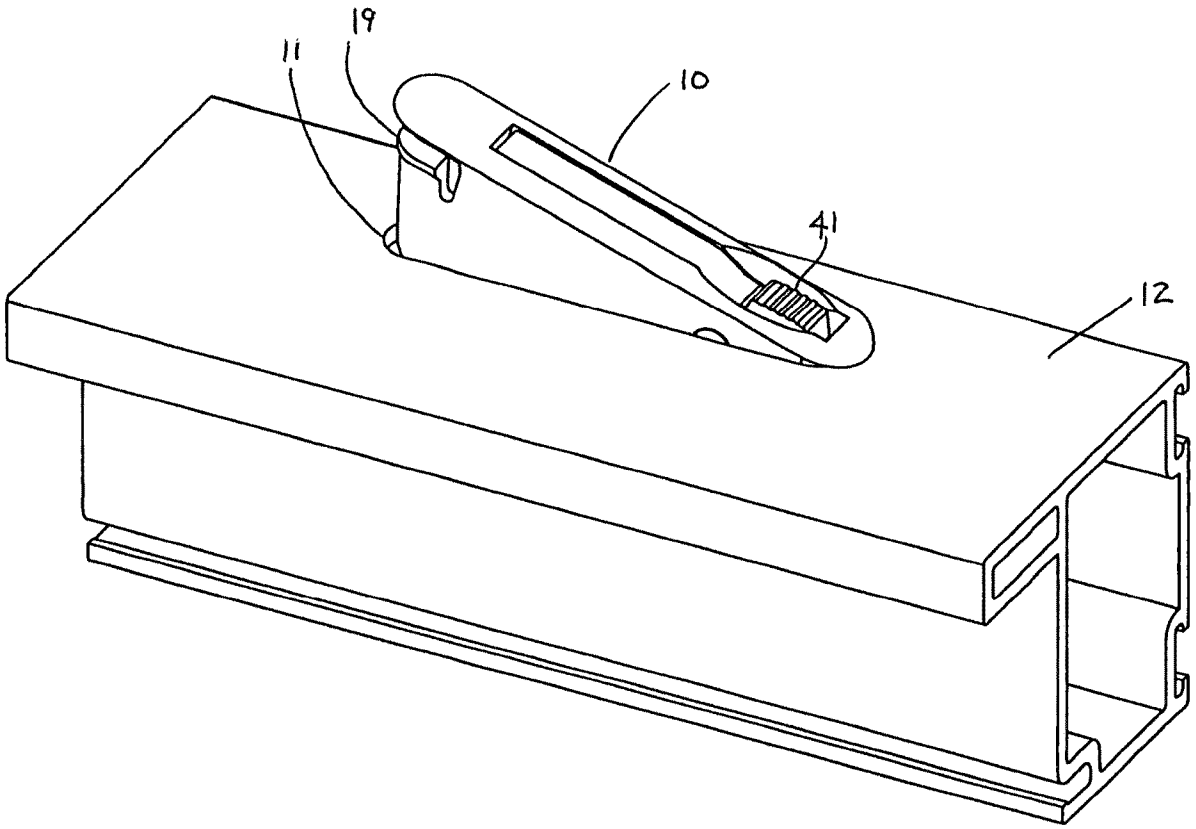
FIG. 6 is a top perspective view of the vent stop of FIG. 1 partially installed in a slot in a window or door sash.
Figure 13:
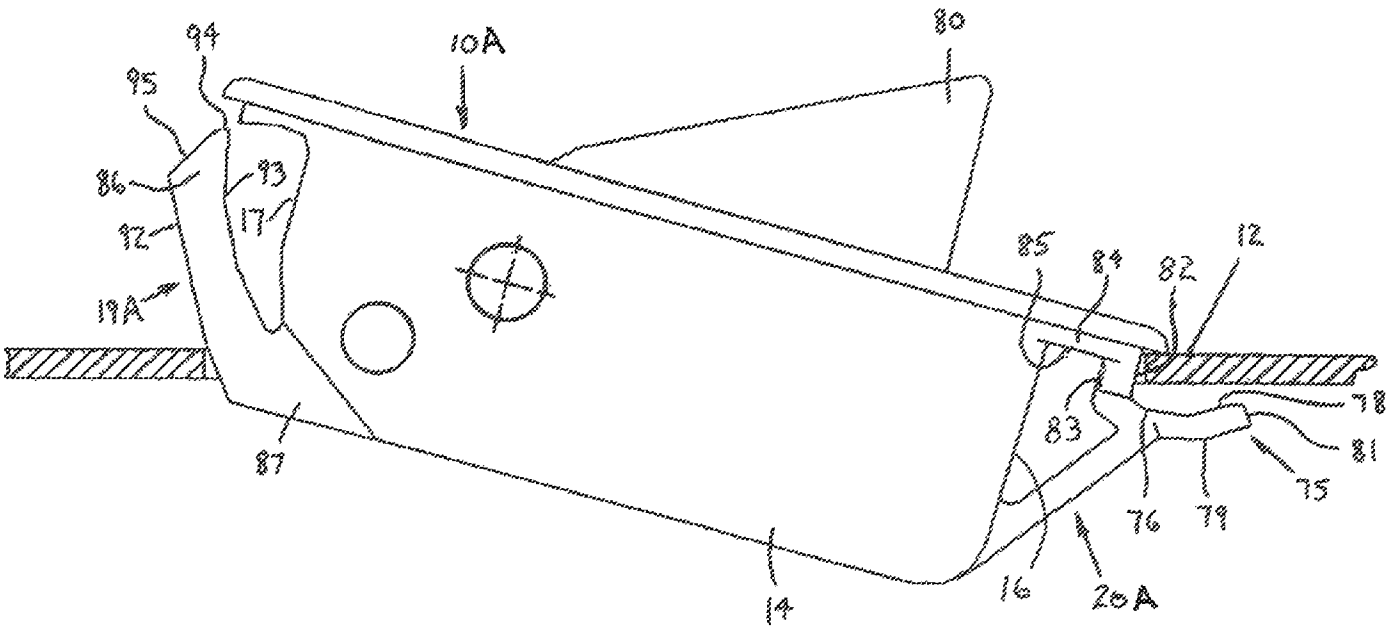
FIG. 13 is a side cross-sectional view of the vent stop of FIG. 11 as it is being installed into a window sash stile.

The second clip 20 ideally has more flexibility than the first clip 19, as seen in FIG. 1, and is adapted to grip the window sash 12 when a user attempts to install the vent stop, as shown in FIGS. 6 and 13. It may be located at the end of the housing 13. In this embodiment, the vent stop of the present invention can be more compatible with different style doorframes. For greater ease of installation, there is a tab 30 protruding from rear wall 17 of housing 13 as seen in FIG. 1, which ensures enough space between the clip and the housing 13. When the vent stop 10 is depressed into slot 11 on a window sash 12, the second flexible clip 20 should be inserted sideling into slot 11 as seen in FIGS. 6 and 13. Flexible clips 19 and 20 can engage a portion of the window sash 12, as seen in FIG. 6. This engagement can prevent vertical (front and back) movement of the vent stop 10 within the window sash 12, as well as preventing the vent stop 10 from being easily dislodged from slot 11.

Figure 7:
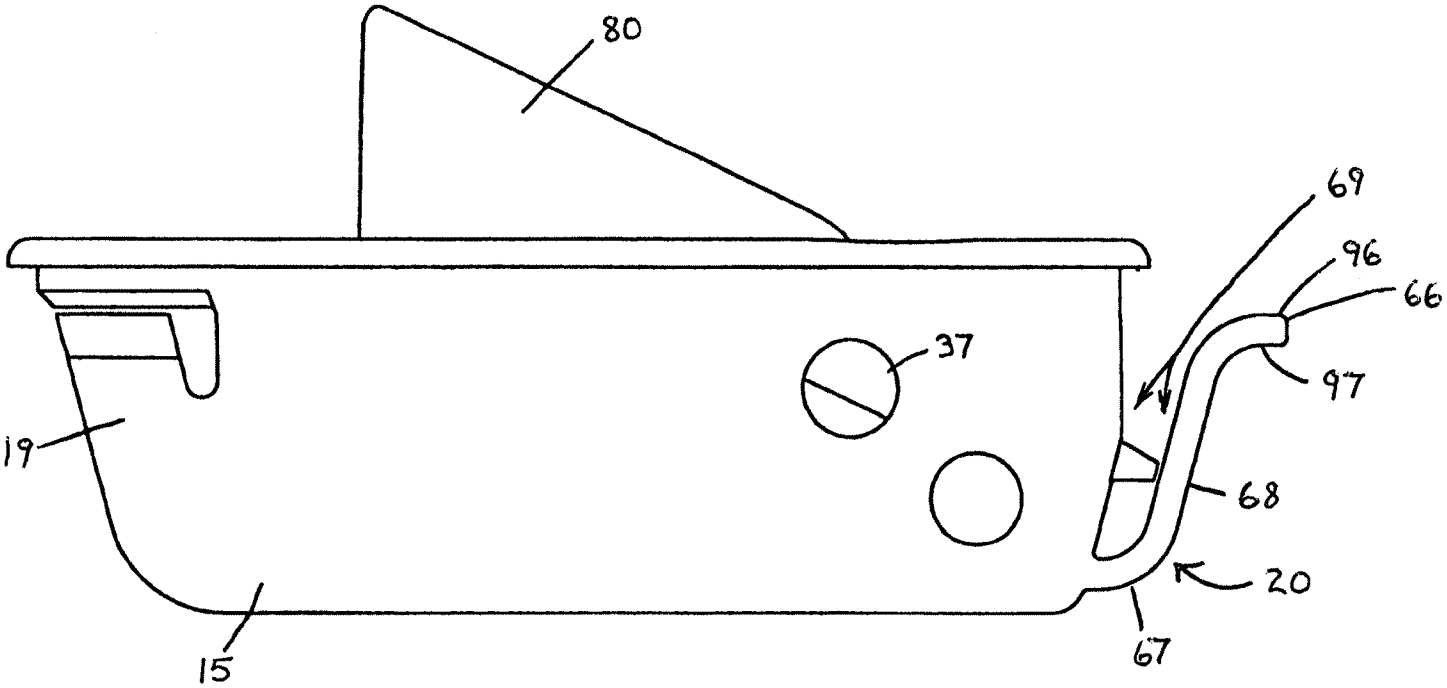
FIG. 7 is a side view of the vent stop of FIG. 1 showing the side opposite the one shown in FIG. 1.

The shapes that second clip 20 could have are virtually endless, so long as the clip 20 maintains its flexibility while still possessing the ability to grip the window sash 12, to provide a clean installation of the vent stop 10. However, in one embodiment, the second clip 20 preferably is "S"-shaped, characterized by curved upper and lower portions 66 and 67, each connected by a generally flat center portion 68, as shown in FIG. 7. In this embodiment, the lower portion 67 of the second clip 20 preferably is connected to the rear wall 17 of the housing 13; nevertheless, the clip 20 could be secured to the housing 13 at any feasible point along the rear wall 17. The lower portion 67 of the second clip 20 is arcuate, curving upward toward the flat center portion 68, creating an S-shaped clip, that strongly resembles the appearance of the "integral" sign in calculus. However, the bottom portion 67 could be curved in an opposite manner, or could even be flat, at an angle to the center portion 68 of the clip 20 in alternate embodiments. In another alternate embodiment, the second clip 20 does not even have a lower portion and the center portion 68 extends diagonally outwardly from the rear wall 17 of the housing 13. The center portion 68 of the second clip 20 extends diagonally outwardly from the lower portion 67, creating a gap 69 between it and the rear wall 17. This gap 69 allows the clip 20 to bend inwardly upon the installation of the vent stop 10. In alternate embodiments, however, the center portion 68 may extend straight in an upward direction from the lower portion 67 rather than outwardly. In other embodiments, the center portion 68 may be more S-shaped, with a portion that extends outwardly from the lower portion 67 and then inwardly toward the rear wall 17. Alternatively the distance the clip 20 maintains between it and the rear wall 17 may be adjustable based on the desired flexibility. The upper portion 66 of the second clip 20 is a generally curved piece, arced in the opposite direction of the lower portion 68. But, in alternate embodiments it may be curved in a different direction, such as upward. The upper portion has top and bottom surfaces 96 and 97. The top surface 96 of the upper portion 66 is where the window sash or other window sash 12 may rest when the vent stop is secured. The top surface 96 of the upper portion 66 of the second clip 20, along with the underside of the lip 33 of the top plate 21, act as a gripping mechanism holding the window sash in place. Although the upper portion 66 is generally short, equal in length to the lower portion 67, it may be longer or shorter as desired.

Figure 11:
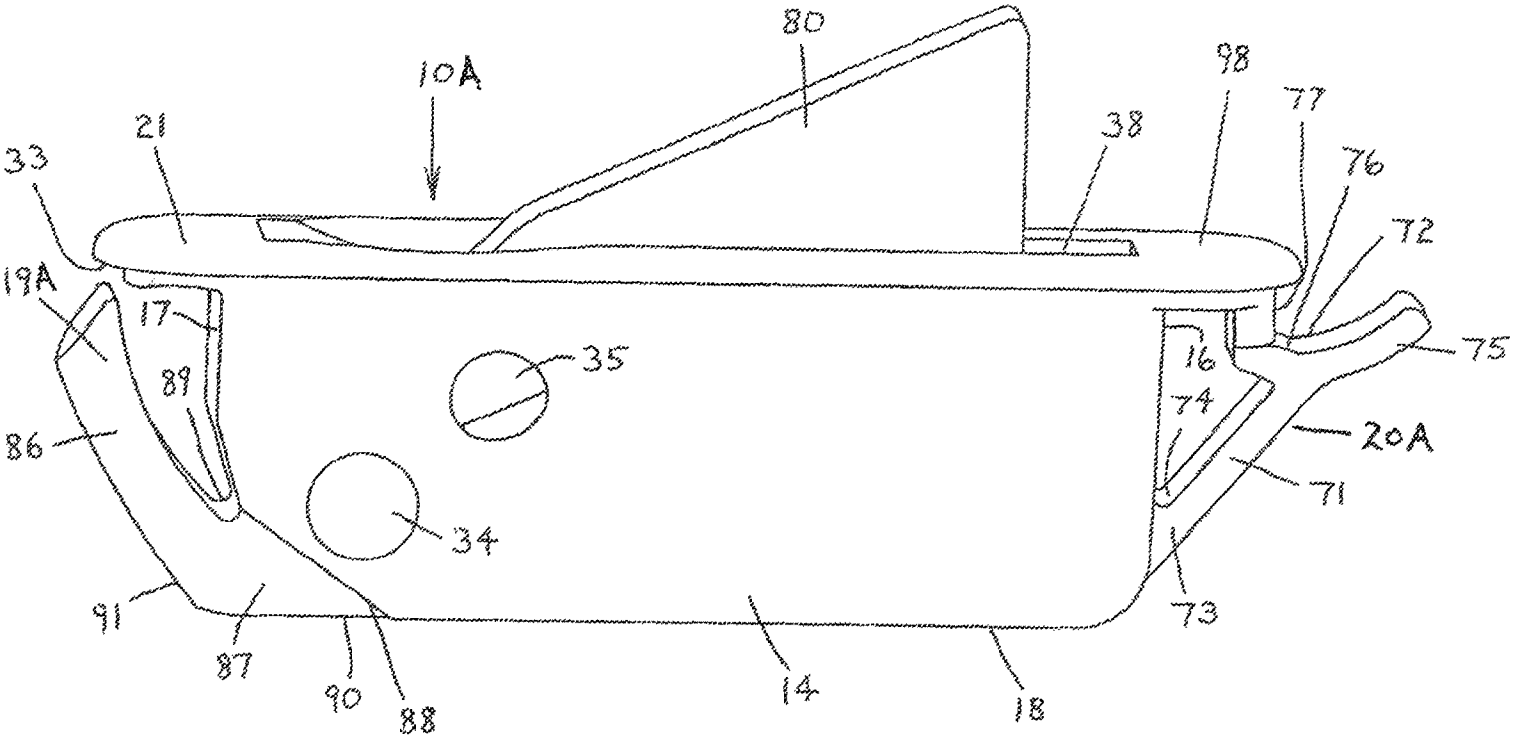
FIG. 11 is a side view of a preferred embodiment of the vent stop of the present invention different from the embodiment in FIGS. 1-10.
Figure 12:
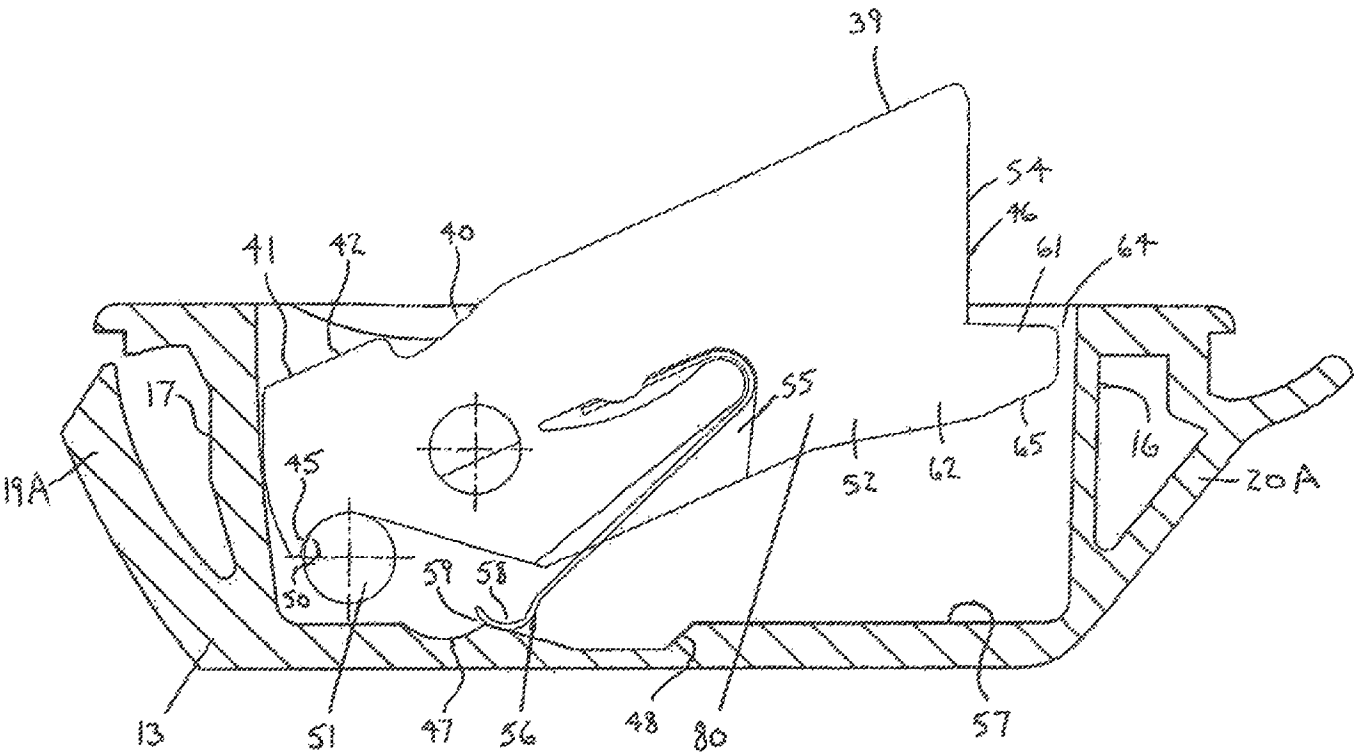
FIG. 12 is a cross-sectional view of the vent stop of FIG. 11.
Figure 12A:
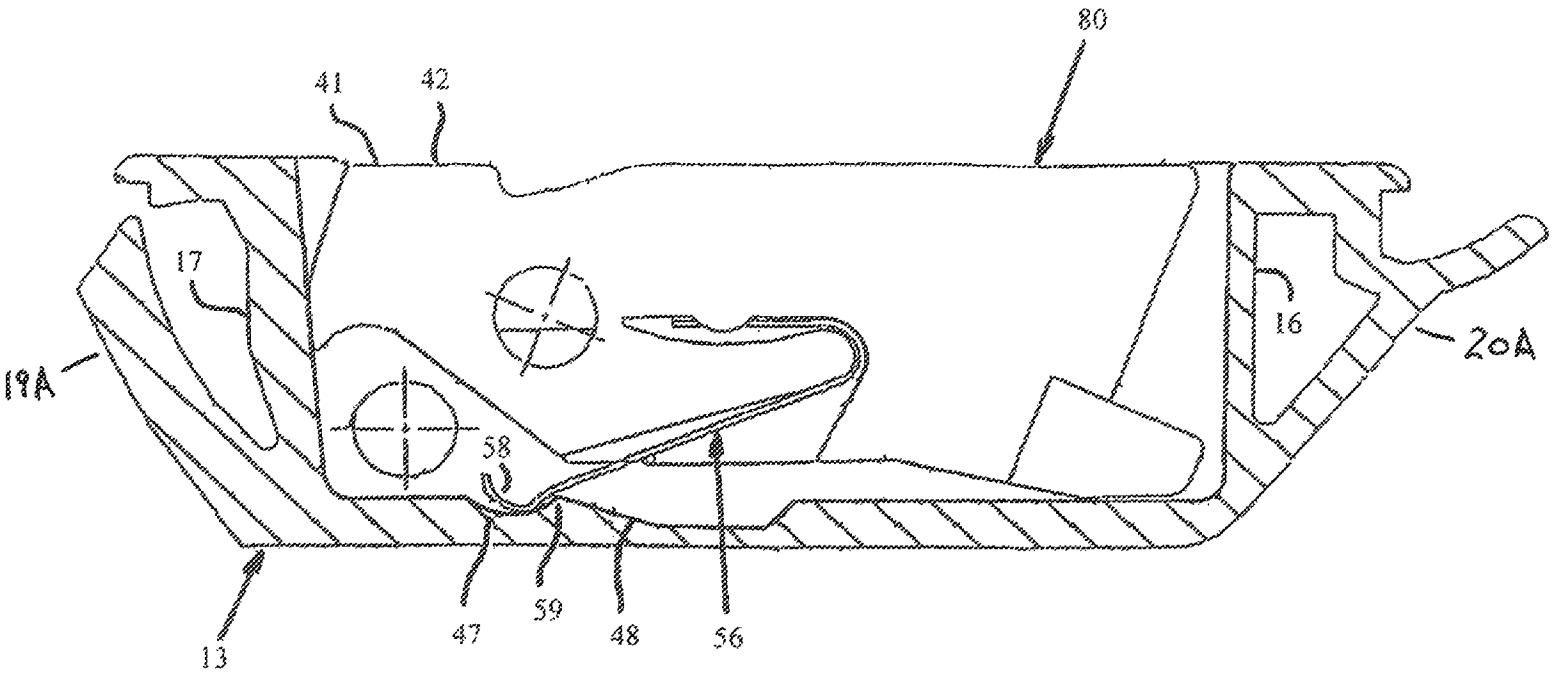
FIG. 12A is a cross-sectional view of the vent stop of FIG. 12, but with the tumbler shown in the retracted position.
Figure 14:
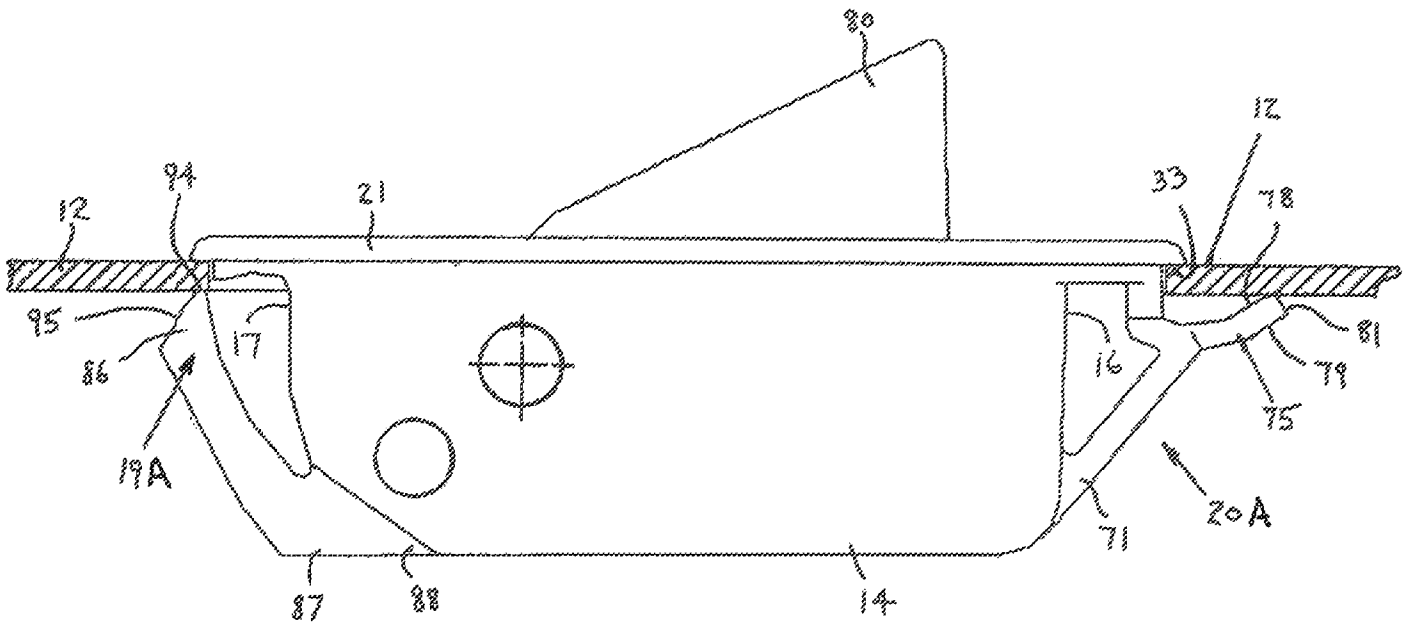
FIG. 14 is a side cross-sectional view of the vent stop of FIG. 13 after it has been installed in the sash stile.

In another preferred embodiment, for the vent stop 10 A shown in FIGS. 11-15, the first clip 19A has only one protrusion 86, which extends outwardly from the rear wall 17 of the housing 13. This embodiment of the first clip, is characterized by a protruding arm 86 and a base portion 87 connected to a recessed wall 88 situated between the rear wall 17 and the bottom wall 18 of the housing 13, as shown in FIG. 11. The base portion has top and bottom surfaces 89 and 90 respectively, as well as a rear surface 91, which are all generally flat. Extending from the base portion 87 of the first clip 19A is a single protruding arm 86, which is flexible and is at an angle with the rear wall 17. The arm 86 is generally rectangular, with an inner surface 92, an outer surface 93, a pointed upper surface 94 and a flat side surface 95, as shown in FIG. 13. In one embodiment, as seen in FIG. 12, the flat side surface 95 may be at about a 55 degree angle to the bottom surface of the top plate 21, as side surface 95 may be utilized for engagement with an interior edge of an end of the opening in the window stile, as shown in FIG. 15. When the vent stop is slid into the slot 11 in the window sash 12, this embodiment of the first clip will bend inwardly toward the rear wall 17, until the vent stop fits inside the slot. Once the vent stop 10A has been inserted, the protruding arm 86 will release back to its old position further away from the rear wall 17, with the window sash 12 being secured between the pointed upper surface94 of the first clip 19A and the lip 33 of the top plate 21, as shown in FIG. 14. In alternate embodiments, the shape of the first clip may be changed. For instance, the upper surface 94 does not have to be pointed, and the arm 86 can attach to the housing 13 at a different point along the rear wall 17. Additionally, a raised member, or tab could extend outwardly from the rear wall 17 so as to limit the amount of room the arm 86 has to move inward toward the rear wall 17. Essentially, any embodiment practicable to one in the art that would achieve the flexible support described above is possible.

Another preferred embodiment of the second clip 20 of the vent stop 10 of the present invention can also be seen on the vent stop 10A shown in FIGS. 11-15. In this embodiment, the second clip 20A comprises an arm 71 and a gripping mechanism 72, as shown in FIG. 11. The arm 71 generally has a base portion 73 that extends outwardly from the front wall 16, so that the arm 71 is diagonal to the surface of the front wall 16. In the present embodiment, this base portion 73 is generally characterized by a flat upper surface 74, and a bottom surface which is indistinguishable from the rest of the arm 71, as shown in FIG. 11. In alternate embodiments, the base portion 73 may be longer or curved, much like the lower portion 67 of the S-shaped clip 20 shown in FIGS. 1-10. The arm 71 is generally flat, although, in alternate embodiments, it may be curved as so desired. Extending from the top of the side opposite the base portion 73 of the arm 71 is the gripping mechanism 72 of the second clip.

The gripping mechanism 72 comprises a protruding hook 75, a flat support surface 76 and a vertical retaining block 77. The protruding hook 75 extends outwardly from the top of the arm 71 of the second clip 20A, and it catches the window sash 12 and secures it to the vent stop 10A. It is generally curved upward and has top and bottom surfaces 78 and 79 as well as a front surface 81, as shown in FIG. 13. The window sash generally comes into contact with the top surface 78, where it comes to rest securely upon installation, as shown in FIG. 14. Although the hook 75 is generally curved, it could be flat in another embodiment, as the user desires. It may be curved in the opposite direction in another embodiment. The hook 75 is connected directly to a flat support surface 76, as shown in FIG. 11, the purpose of which is to further secure the window sash 12 to the vent stop 10A. The support surface 76 comes into contact with a vertical retaining block 77, which has a front end 82 and a back end 83, as shown in FIG. 13. This retaining block 77 extends upwardly to the lip 33 of the top plate 21 on the rear end 83, and upwardly toward the underside 85 of an inner flange 84 running parallel to the top plate 21. The retaining block 77 further locks the window sash 12 in place in the clip 20A. In various alternate embodiments, each of the various pieces 75, 76, and 77 of the gripping mechanism 72 may be removed. For instance, one embodiment might utilize the hook 75 and the support surface 76, but not the retaining block 77. Any arrangement that would safely secure the window sash 12 within the grip of the clip 20A that is practicable to one knowledgeable in the art is possible.

In alternate embodiments not yet illustrated a variety of configurations of clips 19 and 20 can be utilized. For instance, since the second clip 20 requires only a gripping mechanism for holding the window sash 12 in place while the vent stop 10 is installed, any practicable gripping mechanism may be utilized. One example would be to utilize two protrusions extending outward from the wall of the housing, with no clip extending upward. One protrusion will fit underneath the window sash 12 and, the other, above it. For the first clip 19, in order to facilitate installation, the clip 19, as seen in FIGS. 11-15 could be concaved on both sides, creating an easier installation into the slot 11 and more flexibility. A final example of an alternate embodiment is if the clips 19 and 20 were on the sidewalls 14 and 15 of the housing 11 rather than the front wall 16 and rear wall 17. In this way, the vent stop 10 could be secured to the window sash 12 in a different manner.

First sidewall 14 has an inner surface, not shown, and outer surface 31, as seen in FIG. 1. Second sidewall 15 has inner surface, not shown, and outer surface 32, as seen in FIG. 3. On sidewalls 14 and 15 there can be four apertures, apertures 34 and 35 on sidewall 14, as seen in FIG. 1, and apertures 36 and 37 on sidewall 15, as seen in FIG. 3. Apertures 34 and 36 of sidewalls 14 and 15, respectively, are aligned along the same central axis and are positioned towards rear wall 17, and are used to prevent tumbler 80 from rotating passed a predetermined area and to support a substantial upward force associated with the lifting of the lower sash against the stopping surface of the latch. Apertures 35 and 37 of sidewalls 14 and 15, respectively, are also aligned along the same central axis; these apertures are designed so as to allow tumbler 80 to rotate in an outwardly fashion. In another embodiment one could implement bored cavities, aligned in a similar fashion, instead of apertures.

In yet another embodiment, sidewalls 14 or 15 may have at least one rotation member extending there from. In this type of embodiment tumbler 80 would have apertures or bored cavities aligned along the same central axis so as to allow tumbler 80 to rotate in an outwardly fashion.

A lip 33 is attached to top plate 21 is preferably at least the same size or larger and the same general shape as slot 11. Thus, when vent stop 10 is placed into slot 11, lip 33 will contact at least the edges of slot 11 or over spread the upper surface of the window sash 12. These dimensional attributes will allow for a tight fit that will exhibit a finished smooth exterior, which can be aesthetically pleasing. Although top plate 21 is referred to as a "plate", it is understood that housing 13, clip 19, lip 33 and top plate 21 can be, integral pieces, without any need for adhesives or assemblage.

In the preferred embodiment second clip 20, attached to the rear of the housing, is preferably almost as high as the lower portion of the housing under the slot 11. Thus, when vent stop 10 is placed into slot 11, clip 20 will contact at least the edges of slot 11 or over spread, the upper surface of the window sash 12. These dimensional attributes will allow for a tight fit that will exhibit a finished smooth exterior, which can be aesthetically pleasing. Although top plate 21 is referred to as a "plate", it is understood that housing 13, clip 19, clip 20 and top plate 21 can be integral pieces, without any need for adhesives or assemblage.

A tumbler 80 is preferably designed to fit within cavity 38 of housing 13, as seen in FIG. 11. Tumbler 80 may have an upper surface 39, which is preferably smooth and/or flat on the front portion, as seen in FIG. 2. Where upper surface 39 is flat, it will exhibit a more finished look for the vent stop 10 when it is placed in window sash 12. Tumbler 80 may have an indent 40 located toward the rear top surface. In addition tumbler 80 may have a grooved top portion 41 located right above indent 40, as in the present invention, which may act as a button 42, so as to allow the user to activate tumbler 80. The rear edge 43 of tumbler 80 slopes downward and comes to a point 44, where rear edge 43 meets arcuate bottom portion 45. Tumbler 80 can have a front end 46 and a rear end 49, along with side surfaces 52. Tumbler 80 can have rotation members 53, which can fit in apertures 35 and 37, of sidewalls 14 and 15 respectively, of housing 13. The rotation members 53 can be located on side surfaces 52, respectively, close to rear end 49. Preferably, rotation members 53 are cylindrical pegs, which protrude from side surfaces 52 of tumbler 80, respectively. The rotation members 53 can allow tumbler 80 to extend outwardly, thus exposing front end face 54 of tumbler 80, which would prevent movement of window sash 12. The tumbler 80 will be allowed to rotate until arcuate surface 45 of tumbler 80 comes into contact with a surface 50 of peg 51, as seen in FIG. 12, and discussed hereinafter. The window vent stop may be constructed of any type of material known in the art, including, but not limited to, plastic, metal, wood, etc., to be capable of withstanding the downward force imposed on the tumbler by the sash window. The peg may be any shape known in the art, including, but not limited to, a cylindrical peg, a rectangular block, or a square peg. In the present embodiment a plastic cylindrical peg was implemented. In addition, cylindrical peg 51 may be a separate part or it may be an integral part of housing 13, however, in the present embodiment the cylindrical peg 51 is a separate member.

Tumbler 80 has a cavity 55 that houses the plate spring 56, as seen in FIGS. 2 and 12. However, this is not the only possible method of attaching a spring to tumbler 80. For example, tumbler 80 can have a protruding peg on either of the side surfaces 52 that could hold the plate spring 56 in place. If this type of spring configuration is implemented, then housing 13 would have to be of such dimensions so as to allow for the additional needed space. Tumbler cavity 55 has a top and bottom surface equal in width to plate spring 56 it houses. Plate spring 56 also has a rounded bottom portion that contacts the left arcuate nest 47 and the right recession 48 in the inner bottom surface 57 of the housing 13 such that the tumbler is forced to a retracted position in the housing or an extended position out of the housing. In another embodiment rounded bottom portion 58 may be replaced by any angled shaped portion known in the art, which is capable of sliding. Inner bottom surface 57 of housing 13 has an arcuate nest 47 for cradling rounded bottom portion 58 of plate spring 56, as seen in FIG. 12. A divide point 59, where the left arcuate nest 47 meets the right recession 48, confines the bottom rounded portion 58 of plate spring 56 to be forced in different directions when the vent stop is activated or deactivated. In normal operation when the user wishes to activate tumbler 80, the user will apply a downward, or inward force to button 42, this will cause rounded bottom portion 58 of plate spring 56 to move out of arcuate nest 47 and pass the divide point 59 and move into the right recession 48 of bottom surface 57 of housing 13. One must point out that arcuate nesting portion 47, divide point 59, right recession 48 of the bottom surface 57 and bottom rounded portion 58 of the plate spring 56 are of great consequence in the operation of this invention.

In addition to the tumbler cavity 55 of tumbler 80, there exists an arcuate surface 45 that interacts with an arcuate surface 50 of cylindrical peg 51. Arcuate surface 45 is preferably located on the rear bottom portion of tumbler 80. Tumbler 80 may have a protruding portion 60 located at the bottom front end wall of tumbler 80, as seen in FIG. 2. The protruding portion 60 has a top surface 61 that extends perpendicularly from the front end face 54 of the tumbler 80. The protruding portion 60 also has a first side 62, as seen in FIG. 2, and a second side, not shown, a frontface 64, and a bottom 65, as shown in FIG. 12. Bottom 65 of the protruding portion 60 extends outwardly in the same direction as top surface 61 so as to meet with the outside edge of front end face 64 and is parallel to the upper surface 39 so as to come into contact with the bottom surface 57 of the housing 13 and limit further rotation of the tumbler 80 in the housing 13 when the tumbler 80 is in the retracted position. The protruding portion 60 may be designed as to allow a meshing between the protruding portion 60 and the bottom surface of top plate 21, which would cause tumbler 80 from further rotating outwardly; thus if needed, protrusion 60 could be used as a limiting device.

The release of the tumbler 80 from housing 13 can be controlled by an interaction between button 42 and plate spring 56 in tumbler 80 and bottom surface 57 of the housing 13. Button 42, as mentioned previously, is located on the rear end portion of tumbler 80, can have a grooved top surface 41, which can be in the same plane as the upper surface 39 of the tumbler 80, where the user can engage button 42 easily with any suitable instrument known in the art, including but not limited to a finger, fingernail, pen, pencil etc., as seen in FIG. 2. When the user engages grooves 41, it will move rounded bottom portion 58 of plate spring 56 from a cradled position to a freed position within cavity 38 of housing 13. In the present embodiment the user applies a downward or inward force to groove 41 of tumbler 80.

When the user wishes to activate tumbler 80, so as to prevent movement of a sliding window member, the user will exert a downward, or upward force, greater than the force being exerted by the rounded bottom portion 58 of plate spring 56 against the top surface of the arcuate nesting area 47 of the bottom surface 57 of housing 13, on groove 41, of button 42. This force will cause plate spring 56 to move in a direction opposite that of the force applied by the user. When the force applied by the user has reached the critical point, it will cause the rounded bottom portion 58 of plate spring 56 to move out of equilibrium with nesting area 47 of bottom surface 57 of housing 13 and slide across divide point 59 of bottom surface 57 of housing 13 and comes in the next equilibrium with right recession 48 of bottom surface 57 of housing 13. The critical point is reached when the force applied by the user overcomes the static frictional force, at which time bottom round portion 58 of plate spring 56 will begin to slide and the frictional force will drop back to a nearly constant value equal to that of the kinetic frictional force. When tumbler 80 is free to pivot on rotation members 53, the upward force of spring 56 will cause tumbler 80 to rotate in an outwardly direction until the rounded bottom portion 58 of plate spring 56 comes into contact with right recession 48 of bottom surface 57 of housing 13. In the same instance arcuate surface 45 of tumbler 80 will come in contact with arcuate surface 50 of cylindrical peg 51. In addition, a protruding portion 60 can also be implemented, so as to further limit movement of tumbler 80 by coming into contact with bottom surface of top plate 21. Once rounded bottom portion 58 of plate spring 56 has stopped sliding tumbler 80 will be exposed, thus preventing sliding window member from opening any further.

As various changes could be made in the above constructions without departing from the scope of the invention, it is intended that all matter contained in the above description shall be interpreted as illustrative and not in a limiting sense.

The operation of the vent stop according to the present invention will be obvious from the above description thereof.

We claim:

1. A vent stop, for use in an opening in a stile of a sash window, said vent stop comprising:

a housing comprising: a top plate and one or more walls, said one or more walls joined to and extending from a bottom surface of said top plate to create a cavity; at least a portion of said top plate configured to overhang beyond at least a portion of said one or more walls to create a lip, said top plate comprising an opening into said cavity; said housing comprising a first end and a second end;

a tumbler pivotally mounted in said housing cavity and configured to pivot outwardly from a retracted tumbler position into an extended tumbler position where a portion of said tumbler protrudes out from said opening in said top plate;

a spring configured to bias said tumbler relative to said housing;

means for securing said first end of said housing to a first end of the opening in the window stile; and a retention member, said retention member mounted to said second end of said housing distal from said top plate and configured to cantilever away from said second end of said housing in a direction generally toward said lip of said top plate, said retention member configured to be at an angle with respect to said second end of said housing when in an extended position, said retention member configured to be flexible with respect to said housing, to resiliently flex from said extended position into a retracted position where a distal end of said retention member is proximal to said second end of said housing; said distal end of said retention member comprising an engagement surface, said engagement surface comprising a first portion and a second portion, said first portion comprising a substantially flat surface being at about a 55 degree angle to a bottom surface of said lip of said top plate when said retention member is in said extended position, and said second portion comprising an apex configured to be proximate to said bottom surface of said lip of said top plate but offset therefrom, said flat surface of said first portion positioned adjacent to said apex of said second portion with said first portion positioned further from said housing than said second portion, said retention member configured to flex into said retracted position when inserted in the opening in the window stile and to flex back toward said extended position when installed therein such that said first portion of said engagement surface is in an engagement position with respect to an interior edge of a second end of the opening in the window stile to secure said second end of said housing to the stile.

2. The vent stop according to claim 1, further comprising a stop configured to limit said outward pivoting of said tumbler in said extended tumbler position.

3. The vent stop according to claim 1, said housing further comprising a bottom wall distal from said top plate.

4. A vent stop, for use in an opening in a stile of a sash window, said vent stop comprising:

a housing comprising: a top plate and one or more walls, said one or more walls joined to and extending from a bottom surface of said top plate to create a cavity; at least a portion of said top plate configured to overhang beyond at least a portion of said one or more walls to create a lip, said top plate comprising an opening into said cavity; said housing comprising a first end and a second end;

a tumbler pivotally mounted in said housing cavity and configured to pivot between a retracted tumbler position and an extended tumbler position where a portion of said tumbler protrudes out from said opening in said top plate;

a spring configured to bias said tumbler toward said extended tumbler position;

a first retention member, said first retention member comprising a curved member configured to protrude from said first end of said housing, said first retention member configured to secure said first end of said housing to a first end of the opening in the window stile; and a second retention member mounted to said second end of said housing distal from said top plate and configured to cantilever away from said second end of said housing in a direction generally toward said lip of said top plate, said second retention member configured to be at an angle with respect to said second end of said housing when in an extended position, said second retention member configured to be flexible with respect to said housing to resiliently flex from said extended position into a retracted position where a distal end of said second retention member is proximal to said second end of said housing; said distal end of said second retention member comprising an engagement surface, said engagement surface comprising a first portion and a second portion, said first portion comprising a substantially flat surface being at about a 55 degree angle to a bottom surface of said lip of said top plate when said second retention member is in said extended position, and said second portion comprising an apex configured to be proximate to said bottom surface of said lip of said top plate but offset therefrom, said flat surface of said first portion positioned adjacent to said apex of said second portion with said flat surface of said first portion positioned further from said housing than said apex of said second portion, said second retention member configured to flex into said retracted position when inserted in the opening in the window stile and to flex back toward said extended position when installed therein such that said first portion of said engagement surface is in an engagement position with respect to an interior edge of a second end of the opening in the window stile to secure said second end of said housing to the stile.

5. A vent stop, for use in an opening in a stile of a sash window, said vent stop comprising:

a housing having a first end and a second end and comprising: a top plate and one or more walls configured to create a cavity, said top plate comprising an opening into said cavity;

a tumbler pivotally mounted in said housing cavity and configured to pivot between a retracted tumbler position and an extended tumbler position where a portion of said tumbler protrudes out from said top plate opening;

a spring configured to bias said tumbler toward said extended tumbler position;

a first retention member comprising a curved member configured to protrude from said first end of said housing to secure said first end of said housing to a first end of the opening in the window stile; and a second retention member mounted to said second end of said housing distal from said top plate and configured to cantilever away from said second end of said housing, said second retention member configured to cantilever in a direction generally toward said top plate, wherein a free end of said second retention member is distal from said second end of said housing when said second retention member is in an extended position; said second retention member configured to resiliently flex from said extended position into a retracted position, wherein said free end is proximal to said second end of said housing when said second retention member is in said retracted position; said free end of said second retention member comprising a substantially flat engagement surface being at about a 55 degree angle to a bottom surface of said top plate when said second retention member is in said extended position; said second retention member configured to flex toward said retracted position when inserted in the opening in the window stile and to flex back toward said extended position when installed therein such that said engagement surface is in an engagement position with respect to an interior edge of a second end of the opening in the window stile to secure said second end of said housing to the stile.

* * * * *